United States Patent [19]

Satoh et al.

[11] Patent Number: 4,828,739

[45] Date of Patent: May 9, 1989

[54] LUBRICATING COMPOSITION AND HYDRAULIC FLUID

[75] Inventors: Yoshiyuki Satoh; Shinji Kida; Hiroshi Kimura; Masaaki Otsuki, all of Ohta, Japan

[73] Assignee: Toshiba Silicone Co., Ltd., Gunma, Japan

[21] Appl. No.: 180,910

[22] Filed: Apr. 13, 1988

[30] Foreign Application Priority Data

Apr. 13, 1987 [JP] Japan ..... 62-90600
Apr. 13, 1987 [JP] Japan ..... 62-90601

[51] Int. Cl.[4] ..... C10M 175/00
[52] U.S. Cl. ..... 252/49.6; 252/78.3
[58] Field of Search ..... 252/49.6, 78.3

[56] References Cited

U.S. PATENT DOCUMENTS 3,291,735 12/1966 Brown ..... 252/49.6
3,304,259 2/1967 Wright ..... 252/49.6
4,652,386 3/1987 Alberts et al. ..... 252/49.6
4,728,450 3/1988 Toya et al. ..... 252/49.6

*Primary Examiner*—Jacqueline V. Howard
*Attorney, Agent, or Firm*—Antonelli, Terry & Wands

[57] ABSTRACT

The present invention concerns a lubricating composition which comprises:

(A) 100 parts by weight of polyorganosiloxane having a viscosity of 50 cSt or more at 25° C., wherein an organic group bonded to a silicon atom being a monovalent hydrocarbon group containing no aliphatic unsaturated bonding and (B) 0.01 to 7 parts by weight of polymethylsilsesquioxane powder having an average particle size of 0.05 to 50 μm.

Also, the present invention concerns a hydraulic fluid which comprises:

(C) 100 parts by weight of polyorganosiloxane having a viscosity of 500 cSt or more at 25° C., wherein an organic group bonded to a silicon atom being a methyl group or a phenyl group, and 0.01 to 7 parts by weight of Component (B) as mentioned above.

14 Claims, No Drawings

LUBRICATING COMPOSITION AND HYDRAULIC FLUID

BACKGROUND OF THE INVENTION

This invention relates to a lubricating composition, more particularly to a lubricating composition which is excellent in lubricity and heat resistance and comprising a polyorganosiloxane oil and polymethylsilsesquioxane powder which is excellent in lubricity and heat resistance.

This invention also relates to a hydraulic fluid used in a viscous coupling unit, more particularly to a hydraulic fluid which can stand high temperature and high shearing force and which comprises a polyorganosiloxane oil and polymethylsilsesquioxane powder.

A silicone oil is excellent in heat resistance as compared with other organic materials and also has lubricity.

Also, it is excellent in cold resistance and radiation resistance as compared with fluorocarbon oils. Thus, it has widely been used as a lubricating oil or a base oil for various materials which are required for lubricity. Among such silicone oils, while a polydimethylsiloxane or a polymethylphenylsiloxane is excellent in heat resistance, most of them are not necessarily satisfy the requirement in the point of lubricity since they have large dynamic friction coefficient. On the other hand, while a polymethylalkylsiloxane (an alkyl group of which has 2 or more carbon atoms) or a polymethylaralkylsiloxane is excellent in lubricity, heat resistance thereof ranks worse position among the silicone oils, therefore they have limitation in working temperature. Also, in order to introduce a trifluoropropyl group or a chlorophenyl group to a silicon atom, it is necessary to take complicated or low yield synthetic reactions, therefore they are employed only in special use. Therefore, it has been demanded a silicone lubricant which can be used at high temperature and is excellent in lubricity.

On the other hand, it has been described out an attempt to improve lubricity and heat resistance by adding powder material such as molybdenum disulfide or silica to a silicone oil such as a polydimethylsiloxane and a polymethylphenylsiloxane. However, since these powder materials have large specific gravities, stability of a system is bad such that they are easily separated and sedimented, or aggregrated in the system. Also, additive agents for improving lubricity at a boundary lubricating state such as an aliphatic acid-modified silicone oil and a halogenated hydrocarbon are known. However, there are disadvantages that they have bad influences to heat resistance, have a limit in formulating amounts due to bad compatibility with polydimethylsiloxane or polymethylphenylsiloxane, and they do not reveal any improving effect in lubricity at high temperature so that they can reveal their characteristics only within the limited range, respectively.

Also, as a hydraulic fluid for torque transmission to be used in a viscous coupling unit, in general, there has heretofore been used a polydimethylsiloxane oil since it has suitable viscosity, has high flash point, is stable against oxidation or pyrolysis at a high temperature and has less viscosity changes when temperature changes.

However, at a torque transmission accompanied by high shearing force, the hydraulic fluid generates heat by its own friction due to extreme shearing force caused between joint members, and local heating is accompanied by friction of the members. Therefore, when the polydimethylsiloxane is used for a long time, there has been recognized defects that viscosity thereof increases or decreases depending on conditions, and in worst case, gelation is caused whereby a function of torque transmission is lost.

Attempts to improve shearing stability and heat resistance have been carried out. For example, a method in which an organosiloxane compound containing both of zirconium atom and cerium atom is added to a polyorganosiloxane oil (Japanese Provisional Patent Publication No. 185597/1986), or a method in which a polyorganosiloxane oil with low viscosity and that with high viscosity are mixed and used (Japanese Patent Publication No. 16197/1980) has been conducted.

However, while stability to a shearing force at a relatively lower region can be improved, it is difficult to obtain a hydraulic fluid showing sufficient durability at the conditions of a high shearing force and a high temperature. For example, under the conditions of $5\times10^{-3}$ $s^{-1}$ of shearing rate and 200° C. of temperature, a conventional hydraulic fluid using a polydimethylsiloxane or a polymethylphenylsiloxane causes remarkable change in viscosity or gelation for 100 to 200 hours. Thus, it is necessary to exchange the deteriorated hydraulic fluid or a viscous coupling device.

SUMMARY OF THE INVENTION

An object of the present invention is to provide a silicone lubricating composition which is excellent in lubricity and heat resistance.

Another object of the present invention is to provide a polyorganosiloxane hydraulic fluid which is excellent in shearing resistance and heat resistance and used in a viscous coupling, etc.

The present inventors have conducted studies to obtain lubricating composition and hydraulic fluid which comply with these objects, and as results, they have found that polyorganosiloxane oil in which polymethylsilsequioxane powder is formulated complies with these object, and accomplished the present invention.

That is, the present invention concerns a lubricating composition comprising:

(A) 100 parts by weight of polyorganosiloxane having a viscosity of 50 cSt or more at 25° C., where an organic group bonded to a silicon atom being a monovalent hydrocarbon group containing no aliphatic unsaturated bonding, and (B) 0.01 to 7 parts by weight of polymethylsilsesquioxane powder having an average particle size of 0.05 to 50 μm.

The present invention also concerns a hydraulic fluid comprising:

(C) 100 parts by weight of polyorganosiloxane having a viscosity of 500 cSt or more at 25° C., wherein an organic group bonded to a silicon atom being a methyl group or a phenyl group, and (B) 0.01 to 7 parts by weight of polymethylsilsesquioxane powder having an average particle size of 0.05 to 50 μm.

DESCRIPTION OF THE PREFERRED EMBODIMENTS

The polyorganosiloxane of Component (A) to be used in the lubricating composition of the present invention may be a straight chain or branched molecule, but it is preferred to use a substantially straight polyorganosiloxane since excellent heat resistance can be obtained.

In such a polyorganosiloxane, an organic group bonded to a silicon atom is required to be a monovalent hydrocarbon group containing no aliphatic unsaturated bonding, and more concretely, there may be exemplified by an alkyl group such as a methyl group, an ethyl group, a propyl group, a butyl group, a pentyl group, a hexyl group, a heptyl group, an octyl group, a nonyl group, a decyl group and a dodecyl group; an aralkyl group such as a 2-phenylethyl group and a 2-phenyl propyl group; and an aryl group such as a phenyl group and a tolyl group. In case of an organic group including an aliphatic unsaturated bonding, heat resistance becomes bad. Also, as terminal groups, for obtaining heat resistance, it is preferably terminated by a triorganosiloxy group such as a trimethylsiloxy group, a dimethylphenylsiloxy group, a methyldiphenylsiloxy group and a triphenylsiloxy group.

As the straight polydiorganosiloxane, in addition to polydimethylsiloxane, there may be exemplified a polymethylphenylsiloxane, a polymethylalkylsiloxane (an alkyl group of which has 2 or more carbon atoms), a methylaralkylsiloxane and the like which have a viscosity of 50 cSt or more at 25° C., have any polymerization degree as far as they are oily state, and contain organic groups with any composition ratio. It is preferred to use polydimethylsiloxane and polymethylphenyl siloxane since they show excellent heat resistance. Polydimethylsiloxane is particularly preferred since it shows less change in viscosity when temperature changes.

The above polyorganosiloxane oil is required to have a viscosity of 50 cSt or more at 25° C. and preferably in the range of 1,000 to 500,000 cSt. If it is less than 50 cSt, necessary lubricity cannot be obtained at a high temperature and the polymethylsilsesquioxane of Component (B) formulated is sedimeted. If it exceeds 500,000 cSt, such oil has limitation to use for lubricating composition, since viscous resistance of the system becomes high so that workability becomes poor.

The polyorganosiloxane oil of Component (C) to be used in the hydraulic fluid of the present invention may be exemplified by a polydimethylsiloxane and a polymethylphenylsiloxane having a viscosity of 500 cSt or more at 25° C.

For purpose of antioxidation stability of such polyorganosiloxane oils, 3 to 40% of organic groups attached to silicon atoms are preferably phenyl groups, and more preferably 5 to 20%.

Siloxane bondings which constitute molecular skeleton may be a straight or branched, but it is preferred to use a substantially straight polyorganosiloxane since excellent heat resistance can be obtained. Also, molecular terminal ends may preferably terminated by a triorganosiloxy group such as a trimethylsiloxy group to provide excellent shearing resistance and heat resistance.

The above polyorganosiloxane oil is necessarily required to have a viscosity of 500 cSt or more at 25° C. and preferably in the range of 1,000 to 500,000 cSt. If it is less than 500 cSt, necessary torque transmission force cannot be obtained and the polymethylsilsesquioxane of Component (B) formulated is sedimented. From the viewpoint of torque transmission efficiency, it is preferred to have high viscosity but if it exceeds 500,000 cSt, workability becomes bad so that it has limitation in use for hydraulic fluid.

For purpose of making the apparent viscosity decrease of the oil small, under high shear force use, it is preferable that the molecular weight dispersion, which is a number of weight average molecular weight devided by number average molecular weight, is 2 or smaller.

The polymethylsilsesquioxane powder of Component (B) is commonly used in both of the lubricating composition and the hydraulic fluid of the present inventions. Component (B) is, in the lubricating composition of the present invention, to improve lubricity and heat resistance remarkably, which are characteristic points of the composition, and in the hydraulic fluid of the present invention, to improve anti-shearing stability and heat resistance remarkably. Component (B) substantially comprises methylsilsesquioxane units and has methyl groups bonded to silicon atoms. Therefore, it has a small specific gravity as compared with silica powders such as pulverized quartz and diatomaceous earth, as well as it has an affinity to polyorganosiloxane oils of Components (A) and (C). Accordingly, sedimentation and aggregation of the powder hardly occurs, and viscosity increase of the system by formulating the powder is small and the system has good flow.

As the polymethylsilsesquioxane, preferred are those obtained by hydrolysis and condensation of a methyltrialkoxysilane and/or its partial hydrolyzate in an aqueous solution of ammonia or an amine, since they contain substantially no impurities such as a chlorine atom, an alkaline earth metal, an alkali metal, etc. Such polymethylsilsesquioxane is spherical and has free flowing property, and has excellent uniformity in particle size. An average particle size of the polymethylsilsesquioxane should be 0.05 to 50 μm and preferably 0.1 to 20 μm. When it is less than 0.05 μm, there is a disadvantage that it is difficult to produce. If it exceeds 50 μm, it is not preferred since it causes sedimentation in the lubricating composition or in the hydraulic fluid of the present invention.

Formulating amount of Component (B) should be 0.01 to 7 parts by weight, and more preferably 0.1 to 5 parts by weight based on 100 parts by weight of Component (A) or Component (C). If the amount is less than 0.01 part by weight, effects of formulating Component (B) cannot be obtained, and if it is more than 7 parts by weight, no further improvement can be obtained in proportion to increase of the amount formulated.

In the hydraulic fluid of the present invention, there may be formulated an organic salt of a metal such as iron, cesium, zirconium, etc.; a phenol series antioxidant; a heat resistance improver such as an amine compound; and an oilness improver such as an aliphatic acid-modified polysiloxane; etc., if desired.

The lubricating composition of the present invention shows excellent lubricity such as a low dynamic friction coefficient and also excellent in heat resistance. Further, since there is no sedimentation of powder in the composition during storage, it is not necessary to add a dispersion aid.

Accordingly, the lubricating composition of the present invention can be suitably used as a lubricant which is used in severe condition such as under a high temperature.

Also, the hydraulic fluid of the present invention is excellent in shearing resistance and heat resistance, and particularly, under conditions of high temperature accompanied by abrasion of members due to high shearing force, increase or decrease in viscosity is scarcely observed. Further, there is no sedimentation of powder in the fluid during storage. Thus, the hydraulic fluid of the present invention shows sufficient durability, when it is employed in a device for transmitting a torque, by filling it in an inner portion of a viscous coupling unit such as a fan coupling device for cooling an automobile engine or a viscous coupling unit which is used as a limit differential device for automobile driving.

In the hydraulic fluid of the present invention, while it is uncertain concerning a mechanism of improvement of stability due to formulation of the polymethylsilsesquioxane powder, it can be considered that it restrains generation of heat due to local friction between coupling unit members when a high shearing force is applied thereto and also prevents local deterioration of the polyorganosiloxane oil so that whole hydraulic fluid can be stabilized. In any case, by using the hydraulic fluid of the present invention, lifetime of a viscous coupling unit member can be remarkably elongated as compared with the case where a conventional hydraulic fluid is used.

EXAMPLES

In the following, the present invention will be explained by referring to the Comparative examples and Examples, in which parts represents parts by weight.

Measurement method of dynamic friction coefficient

It was measured by using the Sota's pendulum type testing machine at a temperature of 25° C.

Measurement method of heat resistance

Sample (100 g) was encapsulated in 150 ml (inner volume) of iron-made vessel and allowed to stand in a 180° C. oven for 550 hours, and thereafter a viscosity thereof was measured at 25° C., and it was compared with its initial viscosity.

Base oil of lubricating composition

Base oils as shown in Table 1 were used.

TABLE 1

| | Molecular structure | Siloxane skeleton | Viscosity (25° C.) [cSt] |
|---|---|---|---|
| F-1 | Polydimethylsiloxane<br>terminal group: trimethylsiloxy group | linear | 10,000 |
| F-2 | Polymethylphenylsiloxane<br>phenyl group: 20 mole %<br>terminal group: trimethylsiloxy group | linear | 9,800 |
| F-3 | Polydimethylsiloxane<br>terminal group: trimethylsiloxy group | linear | 1,000 |

Measurement method of durability 100 ml of the hydraulic fluid were filled in a viscous coupling unit capable of differential rotation, continuous driving of the viscous coupling device was effected with a differential rotation number of 100 rpm and a shearing rate of 3,500 $s^{-1}$. At this time, temperature was controlled so as to become a temperature of the hydraulic fluid in the unit being 200°±5° C. By measuring an initial transmitted torque value and a torque value after 300 hours with the conditions as mentioned above, and the ratio of these values was obtained. Also, when torque transmission function was lost before 300 hours due to viscosity change or gellation, a driving time led to it was recorded.

Examples 1 to 5, and Comparative examples 1 and 2

To 100 parts of the base oil F-1 were formulated various kinds of powders as shown in Table 2, and by using an automatic mortar, they were stirred for about 10 minutes and uniformly dispersed to prepare samples according to the present invention and comparative samples. With respect to each sample, viscosity, specific gravity, dynamic friction coefficient and heat resistance were measured and a state of the mixture after 96 hours from formulation was observed, respectively. The results are shown in Table 2. Comparative example 1 is an example not formulating powder and Comparative example 2 is an example formulated with precipitated silica.

TABLE 2

| | Example 1 | Example 2 | Example 3 | Example 4 | Example 5 | Comparative example 1 | Comparative example 2 |
|---|---|---|---|---|---|---|---|
| Formulated amount of powder (parts) | 1 | 3 | 4.5 | 7 | — | — | — |
| Polymethylsilsesquioxane (average particle size: 2.5 μm) | — | — | — | — | 3 | — | — |
| Polymethylsilsesquioxane (average particle size: 1.5 μm) | — | — | — | — | — | — | 3 |
| Precipitated silica (average particle size: 0.03 μm) | | | | | | | |
| Viscosity (25° C.) [cSt] | 10,200 | 10,500 | 11,000 | 10,000 | 10,600 | 10,000 | 14,500 |
| Specific gravity (25° C.) | 0.974 | 0.977 | 0.982 | 0.989 | 0.977 | 0.972 | 0.980 |
| Dynamic friction coefficient (25° C.) | 0.160 | 0.150 | 0.155 | 0.170 | 0.145 | 0.280 | 0.300 |
| Viscosity after heat resistance test (25° C.) [cSt] | 10,000 | 10,200 | 10,500 | 10,900 | 10,400 | 8,800 | 4,800 |
| State of mixture | No sedimentation, slightly turbid | No sedimentation, slightly turbid | No sedimentation, slightly turbid | No sedimentation, slightly misty | No sedimentation, slightly turbid | Transparent | Slightly sedimented, opaque |

EXAMPLES 6 AND 7

Experiments were carried out in the same manner as in Examples 1 and 2 except for using 100 parts of F-2 instead of F-1 as a base oil.

Comparative example 3

Experiments were carried out in the same manner as in Examples 6 and 7 as mentioned above except for not formulating the powder.

The results are shown in Table 3.

TABLE 3

| | Example 6 | Example 7 | Comparative example 3 |
|---|---|---|---|
| Formulated amount of powder (parts) Polymethylsilsesquioxane (average particle size: 2.5 μm) | 1 | 3 | — |
| Viscosity (25° C.) [cSt] | 10,000 | 10,500 | 9,800 |
| Specific gravity (25° C.) | 1.024 | 1.026 | 1.023 |
| Dynamic friction coefficient(25° C.) | 0.145 | 0.140 | 0.190 |
| Viscosity after heat resistance test (25° C.) [cSt] | 9,900 | 10,300 | 9,400 |
| State of mixture | No sedimentation, slightly turbid | No sedimentation, slightly turbid | Transparent |

EXAMPLES 8 AND 9

Experiments were carried out in the same manner as in Examples 1 and 2 except for using 100 parts of F-3 instead of F-1 as a base oil.

Comparative example 4

Experiments were carried out in the same manner as in Examples 8 and 9 as mentioned above except for not formulating the powder.

The results are shown in Table 4.

TABLE 4

| | Example 8 | Example 9 | Comparative example 4 |
|---|---|---|---|
| Formulated amount of powder (parts) Polymethylsilsesquioxane (average particle size: 2.5 μm) | 1 | 3 | — |
| Viscosity (25° C.) [cSt] | 1,100 | 1,150 | 1,050 |
| Specific gravity (25° C.) | 0.972 | 0.975 | 0.970 |
| Dynamic friction coefficient(25° C.) | 0.145 | 0.140 | 0.260 |
| Viscosity after heat resistance test (25° C.) [cSt] | 1,050 | 1,080 | 970 |
| State of mixture | No sedimentation, slightly turbid | No sedimentation, slightly turbid | Transparent |

EXAMPLE 10

By using an automatic mortar, 100 parts of linear polydimethylsiloxane (terminal groups: trimethylsiloxy groups) having a viscosity of 10,000 cSt at 25° C. and 3 parts of polymethylsilsesquioxane powder having an average particle size of 2.5 μm was stirred for about 10 minutes and uniformly dispersed to prepare a hydraulic fluid having a viscosity of 10,500 cSt at 25° C. A ratio of a transmission torque value after 300 hours to the initial value, measured by the above described measurement method of durability, was 1.02. Also, after measurement of durability, the hydraulic fluid was taken out from a coupling unit and measured a viscosity thereof at 25° C. The viscosity was 11,500 cSt, which showed that increase in viscosity was extremely small.

Comparative example 5

When the same polydimethylsiloxane used in Example 10 alone was filled without the powder in a viscous coupling unit and carried out a durability test in the same manner as in Example 10, it gelled after 130 hours.

EXAMPLE 11

In the same manner as in Example 10 except for using a linear polydimethylsiloxane (terminal group: trimethylsiloxy groups) having a viscosity of 300,000 cSt instead of 10,000 cSt at 25° C., a hydraulic fluid having a viscosity of 315,000 cSt at 25° C. was prepared. When a durability test was carried out by using this fluid, a ratio of a transmission torque value to the initial value was 1.05. Also, a viscosity of the hydraulic fluid taken out after the durability test was 370,000 cSt.

Comparative example 6

When the same polydimethylsiloxane used in Example 11 alone was filled without the powder in a viscous coupling unit and carried out a durability test in the same manner as in Example 11, it gelled after 130 hours.

EXAMPLE 12

In the same manner as in Example 10 except for using a linear polymethylphenlsiloxane (content of phenyl group: 20 mole %, terminal group: trimethylsiloxy groups) having a viscosity of 100,000 cSt at 25° C. instead of polydimethylsiloxane, a hydraulic fluid having a viscosity of 103,000 cSt at 25° C. was prepared. When a durability test was carried out by using this fluid, a ratio of a transmission torque value to the initial value was 1.00. Also, a viscosity of the hydraulic fluid taken out after the durability test was 106,000 cSt which showed that increase in viscosity was extremely small.

Comparative example 7

When the same polydimethylsiloxane used in Example 12 alone was filled without the powder in a viscous coupling unit and carried out a durability test in the same manner as in Example 12, a transmission torque value after 300 hours increased 1.6-fold of the initial value. Also, a viscosity of the hydraulic fluid was 550,000 cSt which was increased remarkably.

EXAMPLES 13 TO 16

In the same manner as in Example 10 except for varying an formulating amount of polymethylsilsesquioxane powder as shown in Table 5, or except for employing the powder having an average particle size of 1.5 μm instead of 2.5 μm, samples of Examples 13 to 15 or Example 16 were prepared, respectively. The results are shown in Table 5 which shows that each sample shows good characteristics as a hydraulic fluid.

TABLE 5

| | Example 13 | Example 14 | Example 15 | Example 16 |
|---|---|---|---|---|
| Formulated amount of powder (parts) | | | | |
| Polymethylsil- | 1 | 4.5 | 7 | — |

TABLE 5-continued

| | Example 13 | Example 14 | Example 15 | Example 16 |
|---|---|---|---|---|
| sesquioxane (average particle size: 2.5 μm) | | | | |
| Polymethylsilsesquioxane (average particle size: 1.5 μm) | — | — | — | 3 |
| Initial viscosity (25° C.) [cSt] | 10,200 | 11,000 | 11,600 | 10,600 |
| After 300 hours of durability test Ratio of transmitted torque value (vs initial value) | 1.03 | 1.00 | 0.98 | 1.01 |
| Viscosity (25° C.) [cSt] | 12,000 | 11,100 | 10,300 | 11,400 |

We claim:

1. A lubricating composition which comprises:

(A) 100 parts by weight of polyorganosiloxane having a viscosity of 50 cSt or more at 25° C., wherein an organic group bonded to a silicon atom being a monovalent hydrocarbon group containing no aliphatic unsaturated bonding, and (B) 0.01 to 7 parts by weight of polymethylsilsesquioxane powder having an average particle size of 0.05 to 50 μm.

2. A lubricating composition according to claim 1, wherein said polyorganosiloxane oil of Component (A) is a linear polydiorganosiloxane.

3. A lubricating composition according to claim 2, wherein said polyorganosiloxane oil of Component (A) is a polymethylphenylsiloxane.

4. A lubricating composition according to claim 2, wherein said polyorganosiloxane oil of Component (A) is a polydimethylsiloxane.

5. A lubricating composition according to claim 1, wherein a viscosity of said polyorganosiloxane oil of Component (A) at 25° C. is 1,000 to 500,000 cSt.

6. A lubricating composition according to claim 1, wherein an average particle size of Component (B) is 0.01 to 20 μm.

7. A lubricating composition according to claim 1, wherein a formulating amount of Component (B) is from 0.1 parts by weight or more to not more than 5 parts by weight.

8. A hydraulic fluid which comprises:

(C) 100 parts by weight of polyorganosiloxane having a viscosity of 500 cSt or more at 25° C., wherein an organic group bonded to a silicon atom being a methyl group or a phenyl group, and (B) 0.01 to 7 parts by weight of polymethylsilsesquioxane powder having an average particle size of 0.05 to 50 μm.

9. A hydraulic fluid according to claim 8, wherein said polyorganosiloxane oil of Component (C) is a linear polydiorganosiloxane.

10. A hydraulic fluid according to claim 8, wherein a viscosity of said polyorganosiloxane oil of Component (C) at 25° C. is 1,000 to 500,000 cSt.

11. A hydraulic fluid according to claim 8, wherein 3 to 40% of organic groups bonded to silicon atoms in Component (C) polyorganosiloxane oil are phenyl groups.

12. A hydraulic fluid according to claim 8, wherein molecule of Component (C) polyorganosiloxane oil is endblocked with triorganosiloxy groups.

13. A hydraulic fluid according to claim 8, wherein an average particle size of Component (B) is 0.1 to 20 μm.

14. A hydraulic fluid according to claim 8, wherein a formulating amount of Component (B) is from 0.1 parts by weight or more to not more than 5 parts by weight.

* * * * *